United States Patent [19]

Eisenberg et al.

[11] Patent Number: 4,926,801

[45] Date of Patent: May 22, 1990

[54] WET/DRY CYLINDER LINER FOR HIGH OUTPUT ENGINES

[75] Inventors: Eugene Eisenberg, Hagerstown, Md.; Frederick E. Lindsay, Greencastle, Pa.; James J. Evans, Titusville, Fla.; Ronald H. Collins, Waynesboro, Pa.

[73] Assignee: Mack Trucks, Inc., Allentown, Pa.

[21] Appl. No.: 136,400

[22] Filed: Dec. 22, 1987

[51] Int. Cl.[5] ..... F02F 1/10

[52] U.S. Cl. ..... 123/41.84; 123/41.67; 123/193 C

[58] Field of Search ..... 123/41.83, 41.84, 41.72, 123/193 C

[56] References Cited

U.S. PATENT DOCUMENTS

| | | | |
|---|---|---|---|
| 1,665,192 | 4/1928 | Spence | 123/41.84 |
| 2,010,183 | 8/1935 | Furay | 123/41.83 |
| 3,086,505 | 4/1963 | Bovard | 123/41.84 |
| 3,400,695 | 9/1968 | Zaruba | 123/41.84 X |
| 3,714,931 | 2/1973 | Neitz et al. | 123/41.81 |
| 3,745,980 | 7/1973 | Pekar, Jr. et al. | 123/41.74 |
| 4,244,330 | 1/1981 | Baugh et al. | 123/193 C |
| 4,294,203 | 10/1981 | Jones | 123/41.84 X |
| 4,399,783 | 8/1983 | Hauser, Jr. | 123/41.84 X |
| 4,494,492 | 1/1985 | Kochanowski | 123/41.84 |
| 4,562,799 | 1/1986 | Woods et al. | 123/41.67 X |
| 4,759,317 | 7/1988 | Ampferer | 123/41.84 X |

FOREIGN PATENT DOCUMENTS

| | | | |
|---|---|---|---|
| 275926 | 10/1927 | United Kingdom | 123/41.84 |
| 406000 | 2/1934 | United Kingdom | 123/41.84 |

*Primary Examiner*—Craig R. Feinberg
*Attorney, Agent, or Firm*—Bernard, Rothwell & Brown

[57] ABSTRACT

The cylinder liner of an internal combustion engine includes a wet-type upper portion and a dry-type lower portion. The interior wall of the cylinder and the corresponding lower portion of the liner are machined to have an interference fit under operating conditions. The liner is firmly supported by this interference fit engagement of the liner with the cylinder bore over approximately two-thirds the length of the liner. The cylinder wall is machined to provide a shoulder substantially at the junction of the upper and lower portions of the liner and a corresponding shoulder is formed at this point on the liner. These shoulders are forced into firm sealing engagement by the torque applied to the cylinder head screws during asssembly of the cylinder head on the engine block. The vertical dimension of the shoulder on the cylinder liner is formed to be a minimum of ⅛ of the vertical dimension of upper portion of the liner. The upper (wet) portion of the cylinder liner is formed to include alternate thinner and thicker portions, the thicker portions strengthening the liner in the wet area and enabling the overall thickness of this portion of the liner to be smaller than would otherwise be possible. Further, the shapes involved by this construction provide a plurality of parallel annular flow passages by which the cooling fluid is directed in parallel paths around the upper portion of each of the cylinders from one side of each cylinder to the other side thereof.

5 Claims, 3 Drawing Sheets

WET/DRY CYLINDER LINER FOR HIGH OUTPUT ENGINES

BACKGROUND OF THE INVENTION

1. Field of the Invention

This invention relates to cooling arrangements for high output engines, and more specifically to a wet/dry cylinder liner for such engines.

2. Description of the Prior Art

There has been a trend to increase the output of internal combustion engines by increasing the firing pressures and thermal loading of such engines. This trend has tended to favor the adoption of wet-type liners in the cylinder block where the liner is in direct contact with a cooling medium for the greater portion of its length, thereby providing improved heat transfer and allowing the operation of engines at higher firing pressures and increased thermal loading.

However, conventional wet-type cylinder liners have several disadvantages. Since the wet liner requires substantial space for the cooling liquid, use of such liners substantially increases the distance between the center lines of the several cylinders, this increase being necessary to insure space for cylinder block and liner walls of adequate thickness to withstand the increased mechanical and thermal loads and to resist cavitation erosion. Also this increase is necessary in order to provide room for a flange to support the wet-type liner in the cylinder block. The greater distance between cylinder bores, of course, increases the overall length of the engine, and thereby adds cost, weight and bulkiness to the engine.

Wet liners also require the installation of seals between the lower portion of the liner and the cylinder block to prevent the cooling medium from migrating into the oil and vice-versa. These seals are susceptible to damage and adversely affect engine reliability and durability, and increase maintenance costs.

On the other hand, a fully dry liner, where the liner is separated from the cooling medium throughout its entire length also has several disadvantages. The heat transfer between the liner and the cooling medium is restricted because the coolant flow is disrupted by cast cylinder head screw bosses located around the upper portion of the liner. Also it is difficult and expensive to cast clean cooling passages around the liner supporting structure of the cylinder block. Finally, the dry-type liner has a lesser capacity for heat dissipation from the cylinder than a fully wet-type liner.

Thus, both conventional types of liners, namely the fully wet-type and the fully dry-type, have significant disadvantages.

The present invention provides a hybrid wet/dry cylinder liner which combines the best features of conventional wet cylinder liners and conventional dry cylinder liners. More specifically, the present invention provides a structure in which the upper portion of the liner, where combustion occurs and where therefore heat transfer is most important, is of the wet-type, while the lower portion of the liner, where less heat transfer is needed, is constructed of a dry-type thin wall configuration not requiring any cooling. The present invention allows engines to be constructed with the distance between the cylinder bores the same as that for present day engines with completely dry liners by dividing the liner into two distinctive portions, one wet and one dry. The upper, or wet, portion of the liner is provided with a fully controlled passage around the liner for cooling fluid. At the same time the lower, or dry, portion of the liner is constructed to provide a firm support for the entire liner and also to provide a seat for the liner which eliminates any need for an additional seal between the upper (wet) and lower (dry) portions of the liner and eliminates the need for any additional seal normally required with wet-type liners to preclude mixing of the coolant with the oil of the cylinder.

Accordingly, it is an object of this invention to combine the best features of wet and dry-type liners presently used in high output internal combustion engines, while eliminating the disadvantages of each type of liner.

It is another object of this invention to provide increased cooling in the upper part of the cylinder where firing occurs and where the heat is greatest and reduced cooling in the lower part of the cylinder where the cooling requirements are not as great.

It is a further object of this invention to provide a construction in which the engagement of the lower (dry) portion of the cylinder liner provides effective support for the entire liner and enables the upper (wet) portion of the liner to be made thinner than would otherwise be the case.

It is still another object of this invention to provide a construction in which a shoulder on the liner is brought into sealing engagement with a shoulder on the cylinder wall eliminating the need for a special seal therebetween.

SUMMARY OF THE INVENTION

In accordance with the present invention, in one form thereof, a cylinder liner is formed so that the upper portion, covering approximately one-third of the length of the liner, is constructed to be a wet-type liner, and the lower portion, extending over approximately two-thirds of the length of the liner, is arranged to be a dry-type liner. The interior wall of the cylinder and the corresponding lower portion of the liner are machined so as to have an interference fit under operating conditions. The liner is firmly supported by this interference fit engagement of the liner with the cylinder bore over approximately two-thirds the length of the liner. This has the further advantage of enabling the upper portion of the liner above this interference fit (that is the wet portion of the liner), to be made thinner than would otherwise be possible and thereby to reduce the distance between the bores of adjacent cylinders. The cylinder wall is machined to provide a shoulder substantially at the junction of the upper (wet) and lower (dry) portions of the liner and a corresponding shoulder is formed at this point on the liner. These shoulders are forced into firm sealing engagement by the torque applied to the cylinder head screws during assembly of the cylinder head on the engine block. The vertical dimension of the shoulder on the liner is formed to be a minimum of $\frac{1}{8}$ of the vertical dimension of the upper (wet) portion of the liner. The wet portion of the cylinder liner is formed to include alternate thinner and thicker portions, the thicker portions strengthening the liner in the wet area and enabling the overall thickness of this portion of the liner to be smaller than would otherwise be possible. Further, the shapes involved by this construction provide a plurality of vertically displaced parallel annular flow passages by which the cooling fluid is directed in parallel paths around the upper portion of each of the cylinders from one side of each cylinder to the other side thereof.

BRIEF DESCRIPTION OF THE DRAWINGS

For a better understanding of the invention reference is made to the accompanying drawings in which.

DESCRIPTION OF THE PREFERRED EMBODIMENT

Figure 2:
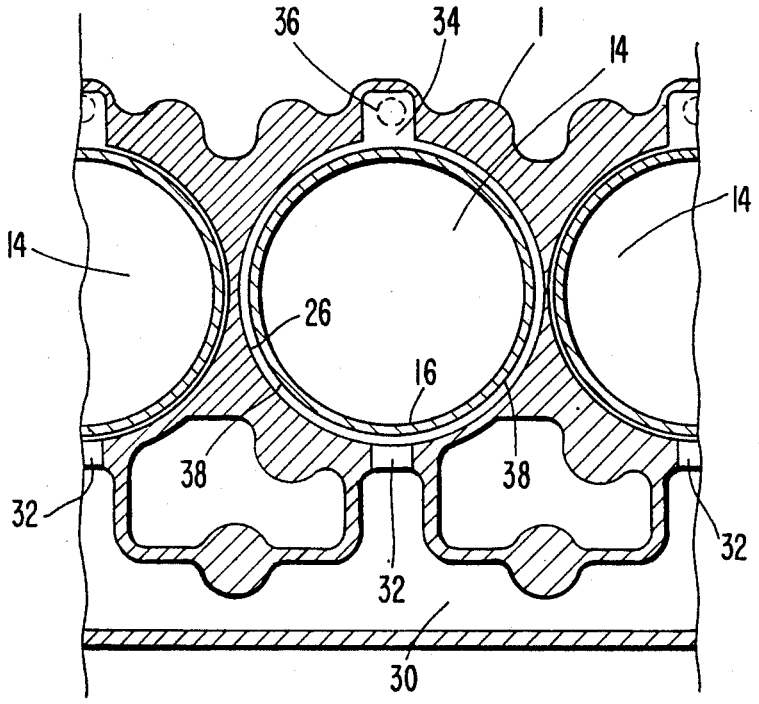
FIG. 2 is a sectional plan view through the engine showing the cylinder illustrated in FIG. 1 and portions of adjacent cylinders of the engine.

In carrying out this invention, in one form thereof, there is provided an internal combustion engine of the high output type which includes a plurality of adjacent cylinders, some of which are illustrated in FIG. 2. The engine which is the subject of this invention is of the type which is increasingly employed wherein the engine output is increased by increasing the firing pressure and thermal loading. The resultant requirement for increased cooling capacity has favored the employment of wet-type cylinder liners for such engines, despite the disadvantages set forth above. In the engine of the present invention, these disadvantages have been overcome while still providing adequate cooling, by employing in each of the cylinder bores a cylinder liner which includes one portion of the wet-type and another portion of the dry-type.

Figure 1:
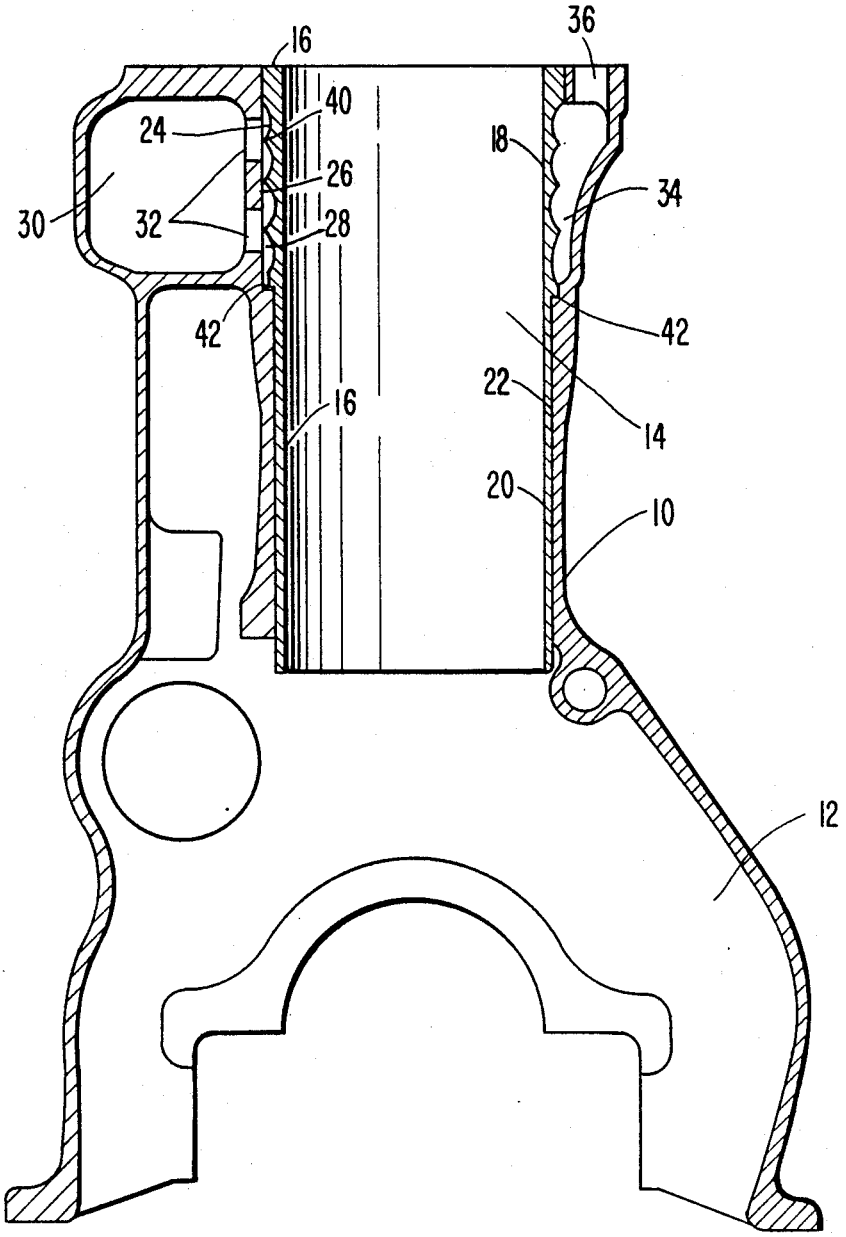
FIG. 1 is a sectional elevation view taken transversely through one cylinder of an internal combustion engine constructed in accordance with this invention.

Referring now to FIGS. 1 and 2, there is shown an engine block 10 including a crankcase 12 at the lower portion thereof and a plurality of cylinder bores 14 in the upper portion thereof. The cylinder bores 14 are fully machined for receiving within each of these bores a cylinder liner 16. In accordance with the present invention, this cylinder liner is formed to provide two portions, an upper portion 18 which is of the wet-type and a lower portion 20 which is of the dry-type. The exterior wall of the lower portion 20 is also fully machined so as to provide an interference fit with the corresponding portion 22 of the cylinder bore under operating conditions. Since the liner 20 under operating conditions is subject to greater heat than the engine block 10, it expands to a greater degree. Accordingly, in the manufacture and assembly of the liner the dimensions of the liner relative to the engine block are such that the liner may be assembled with a sliding fit. However, the dimensions are chosen so that the expansion of the liner under operating conditions will result in the aforementioned interference fit.

The lower portion 20 constitutes the major portion of the length of the cylinder liner. In the particular embodiment disclosed this portion constitutes approximately two-thirds of the length of the cylinder liner and the upper, or wet, portion constitutes approximately one-third of the length. Because of the extent of the length of the cylinder liner received within the cylinder bore and because of the machining of the cylinder bore and this portion of the liner, the aforementioned interference fit achieved provides essentially all of the support required for the cylinder liner. Further, because of the extent of the support thereby provided, it is possible to make the upper portion of the cylinder liner thinner than would otherwise be possible, thereby minimizing the distance between adjacent cylinder bores required to provide space for the upper portion of the cylinder liner. The major portion of the heat developed within each cylinder occurs in the upper portion of the cylinder where the firing takes place. In accordance with the present invention, substantially all of the liquid cooling for the cylinder is provided at this portion, and no separate cooling is provided for the lower dry portion of the cylinder liner.

In order to provide the substantial amount of cooling required in the upper portion of the cylinder the upper portion 18 of the cylinder liner is machined along the exterior surface thereof to provide a plurality of arcuate sections 24. The arcuate sections, in conjunction with the adjacent wall 26 of the cylinder bore, provide a plurality of parallel passages 28 for liquid coolant along the exterior surface of the upper portion of the cylinder liner. Coolant from a coolant pump (not shown) is supplied to a gallery 30 which extends along one side of all of the cylinders of the engine. Separate openings 32 are provided for each of the cylinders to provide communication for each individual cylinder with the gallery 30. The passages 32 specifically provide communication for liquid coolant from the gallery 30 to the plurality of parallel passages 28, as best shown in FIG. 1. At the opposite side of each cylinder there is provided a collector 34 from which liquid coolant is directed through an opening 36 to the cylinder head and thence back to the coolant pump.

The liquid coolant is supplied at substantial pressure from the coolant pump and the gallery 30 to the parallel passages 28 and flows at high velocity through these passages for effectively removing heat from the high heat portion of the cylinder. The coolant is directed, as best shown in FIG. 2, in two semi-circular paths 38 from the openings 32 to the collector 34. The lower portion 20 of the cylinder liner is, as previously mentioned, of the dry-type and is not provided with any liquid cooling, the total cooling for the cylinder being provided by the liquid coolant circulating around the upper one-third of the cylinder liner.

As mentioned previously, the substantial length of the lower portion 20 of the cylinder liner, which has an interference fit with the machined cylinder bore under operating conditions, provides support for the liner which allows the upper portion of the cylinder liner to be made thinner than would otherwise be possible. Further, the arcuate construction of the upper portion of the cylinder liner not only provides the plurality of parallel paths for effective circulation of liquid coolant at high velocity therethrough, but this construction provides alternate thicker portions 40 which increase the strength of the upper portion of the cylinder liner.

A more uniform temperature distribution over the length of the cylinder liner is achieved by the arrangement of this invention. The upper portion 18, which receives the majority of the heat load of combustion, is subjected to a controlled, high velocity coolant flow through the plurality of passages 28. This high velocity coolant is in direct contact with the wet portion 18 of the cylinder liner promoting the most efficient heat transfer. Since the machined arcuate sections 24 provide passages around the cylinder liner of substantially constant cross-section, the velocity of the coolant remains substantially uniform as it circulates around the liner, further contributing to a uniform temperature distribution in the liner. Further, the thinner upper portion 18 of the cylinder liner, made possible because of the firm interference support of a substantial length of the liner in the cylinder bore, further enhances the heat transfer. Additionally, the provision of separate coolant circulation from the gallery 30 around each of the cylinder liners through the semi-circular paths 38 provides for cooling of each of the cylinder liners as a separate entity isolated from the coolant supplied to the adjacent liners. By this parallel arrangement the cooling of one liner is not affected by the cooling of the other liners.

Figure 3:
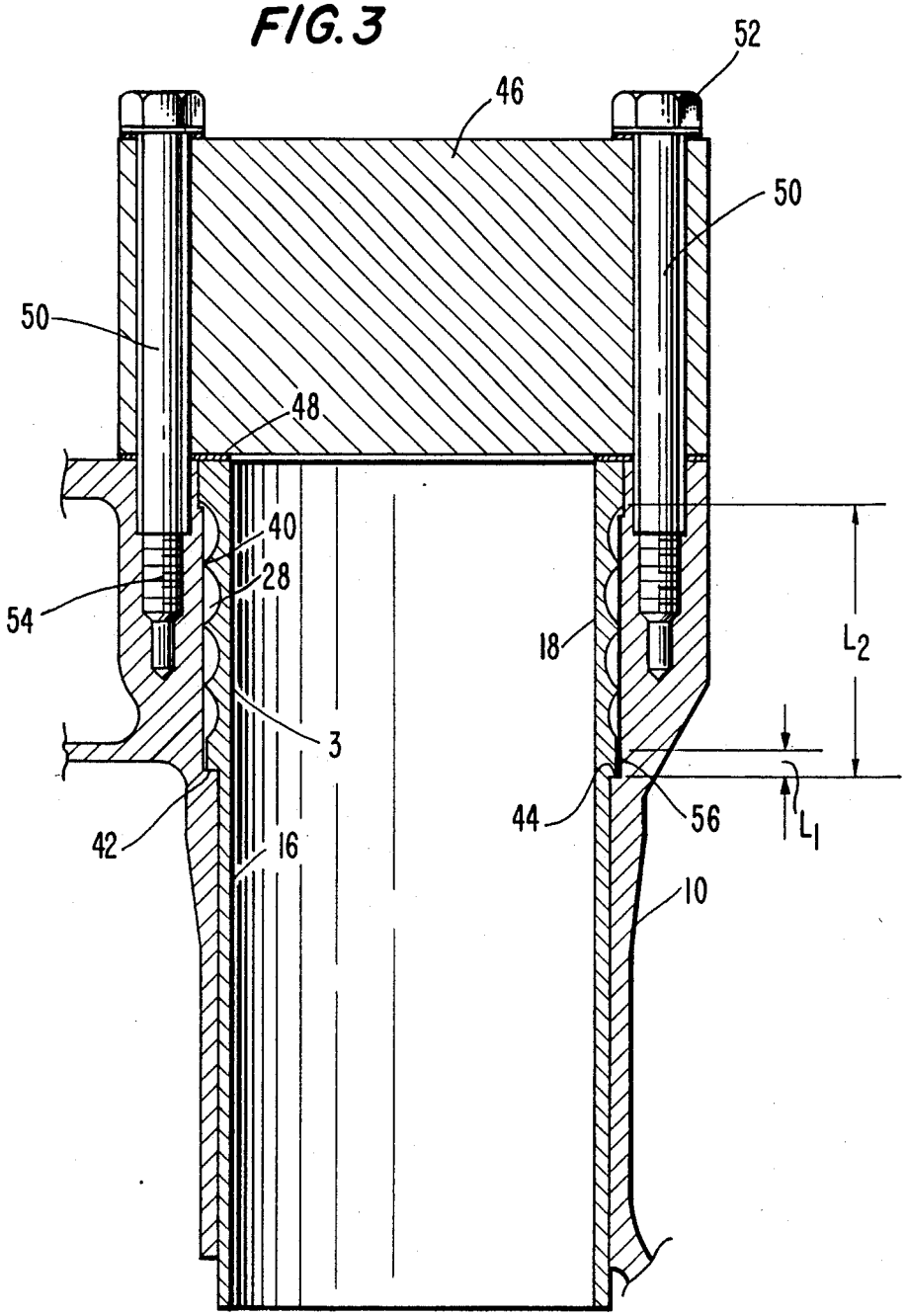
FIG. 3 is a sectional elevation view including a portion of the cylinder head.

Another feature of the present invention is the elimination of the sealing rings which are customarily required with wet-type cylinder liners to preclude the mixing of the liquid coolant with the oil in the crankcase. In the structure of this invention, this need for special seals is eliminated by the substantial length of the interference fit and by providing engaging shoulders on the cylinder liner and the cylinder wall. Specifically, as shown in FIGS. 1 and 3, the cylinder liner is formed to include, substantially at the junction of the upper wet portion 18 and the lower dry portion 20, a shoulder 42. A corresponding shoulder 44 is machined on the cylinder wall for engagement by the shoulder 42. In the assembled position of the engine the shoulder 42 is pressed in firm sealing engagement with the shoulder 44. This, along with the length of the interference fit at the lower portion 20 of the cylinder liner, insures that none of the liquid coolant at the upper portion of the cylinder liner can leak into the oil of the crankcase.

The shoulders 42 and 44 may be pressed into sealing engagement by any suitable means engaging the cylinder block and pressing against the upper end of the cylinder liner. A specific arrangement for accomplishing this objective, without requiring elements beyond those normally employed with conventional engines, is shown in FIG. 3. As there shown, the engine includes a cylinder head 46, and a conventional gasket 48 is positioned between the lower surface of the cylinder head and the upper surface of the block 10. The cylinder head is pressed against the gasket by means of a plurality of screws 50, shown in FIG. 3, the heads 52 of which engage the top of the cylinder head. The threaded portion 54 of each of these screws engages a corresponding threaded portion of the block 10 to provide sealing engagement between the cylinder head and the block. As illustrated in FIG. 3, the cylinder head 46 also presses the gasket 48 against the upper end of the cylinder liner 16 and thereby forces the shoulders 42, 44 of the cylinder liner and the cylinder wall into firm sealing engagement. Thus, the torque applied to the cylinder head screws 50 in the normal assembly of the cylinder head on the block 10 at the same time effects the aforementioned seal between the cylinder liner and the cylinder wall at the shoulders 42, 44.

The construction of the cylinder liner 16 in the vicinity of the shoulder 42 is also important to achieving optimum performance. Specifically, the shoulder 42 of the cylinder liner 16 is formed to have a vertical dimension $L_1$ which is a minimum of $\frac{1}{8}$ of the length $L_2$ of the upper (wet) portion 18 of the liner. This dimensional relationship has been found necessary by the inventors to avoid distortion of the liner under operating conditions. The face 56 of the shoulder 42 is spaced approximately 0.020" from the inner wall of the engine block 10.

By the arrangement of this invention, the optimum advantages of the wet and dry types of cylinder liners have been retained while eliminating the disadvantages of each of these types discussed earlier in this specification. The cooling arrangement of this invention reduces the space required between adjacent cylinders in the case of the normal wet-type liner, and thereby reduces the length, weight and bulkiness of the engine, without sacrificing effective cooling of the engine. Further, by this invention, the special seals previously required with wet-type cylinder liners, and the additional maintenance resulting from the use and periodic replacement of such seals has been eliminated.

It will be understood that, while a specific preferred embodiment of the applicants' invention has been illustrated, modifications may be made without departing from the spirit and scope of this invention. For example, the engine in the illustrated embodiment is of the in-line vertical type, but it will be apparent that the invention is equally applicable to V-type engines. Further, while the passages 28 for cooling the upper portion of the cylinder liner have been, in the embodiment illustrated, formed in the exterior wall of the liner, these passages could, if desired, be formed by machining the arcuate surfaces into the adjacent surface of the cylinder bore instead of in the cylinder liner. However, the form illustrated is preferred because the machining is simpler when the arcuate surfaces are formed on the exterior wall of the cylinder liner.

It is claimed:

1. In an internal combustion engine comprising a cylinder head and a plurality of cylinders each of which includes a cylinder wall and cylinder bore, a cooling arrangement for the engine comprising:

(a) a cylinder liner having a predetermined length and being received in each of said bores, a lower portion of each liner being a dry portion of said liner which is received in a corresponding bore with an interference fit along the substantial length of the lower portion under operating conditions, said lower portion constituting approximately two-third of the length of said liner and providing support for said liner;

(b) an upper portion of said liner being disposed at a combustion region of the cylinder and being formed to provide a plurality of passages for liquid coolant extending in substantially parallel arcuate paths around the cylinder liner, said arcuate paths comprise means for increasing velocity of said liquid coolant around said combustion region said passages being of substantially constant cross-section so as to provide substantially uniform high velocity circulation of liquid coolant around the cylinder liner in said combustion region, the upper portion of the liner constituting approximately one-third of the length of said liner and being a wet portion of the liner with the liquid coolant being in contact with said upper portion of the liner so as to provide the entire cooling for said cylinder liner;

(c) a shoulder formed on said liner approximately at a junction of said upper and lower portions and a shoulder formed on said cylinder wall; and (d) means engaging said cylinder wall for pressing said shoulders in firm engagement so that the engaged shoulders at approximately the junction of said upper and lower portions provide a seal which prevents liquid coolant from contacting the dry lower portion of the cylinder liner.

2. The cooling arrangement of claim 1 wherein said last-named means comprises cylinder head screws and wherein the torque applied to said cylinder head screws in assembling the engine presses said shoulders of said cylinder liner and said cylinder wall into sealing engagement.

3. The cooling arrangement of claim 1 wherein a vertical dimension of the shoulder on said liner is a minimum of ⅛ of a vertical dimension of the upper portion of said liner.

4. The cooling arrangement of claim 1 and further including a coolant gallery extending along one side of said plurality of cylinders; and separate means providing communication for each of said cylinders from said gallery to said passages.

5. The cooling arrangement of claim 4 and further including separate means for each of said cylinders at the side opposite said gallery for receiving coolant circulating through said passages and conducting said coolant to said cylinder head.

* * * * *